US006423912B1

(12) United States Patent
Arenz et al.

(10) Patent No.: US 6,423,912 B1
(45) Date of Patent: Jul. 23, 2002

(54) MANUALLY OPERATED DEVICE HAVING A TURNING HANDLE FOR ELECTRICAL SWITCHING DEVICES

(75) Inventors: Rainer Arenz, Munich; Tom Kitzing, Wiehl, both of (DE)

(73) Assignee: Moeller GmbH, Bonn (DE)

( * ) Notice: Subject to any disclaimer, the term of this patent is extended or adjusted under 35 U.S.C. 154(b) by 0 days.

(21) Appl. No.: 09/641,895

(22) Filed: Aug. 18, 2000

(30) Foreign Application Priority Data

Aug. 21, 1999 (DE) ..... 199 39 717

(51) Int. Cl.[7] ..... H01H 9/28

(52) U.S. Cl. ..... 200/43.08; 200/50.11; 200/336

(58) Field of Search ..... 200/331, 336, 200/338, 50.06, 50.11, 50.01, 43.11, 43.04, 43.08

(56) References Cited

U.S. PATENT DOCUMENTS

| | | | | |
|---|---|---|---|---|
| 2,774,852 A | * | 12/1956 | Boardman | 200/338 X |
| 4,851,621 A | * | 7/1989 | Borchardt et al. | 200/50.01 |
| 5,609,244 A | * | 3/1997 | Reiter | 200/43.11 |
| 5,687,834 A | * | 11/1997 | Simon et al. | 200/336 |

FOREIGN PATENT DOCUMENTS

| | | |
|---|---|---|
| DE | 9405568 | 7/1994 |
| DE | 4312428 | 11/1994 |
| DE | 4322214 | 1/1995 |
| EP | 0 774 766 | 5/1997 |
| GB | 2 149 972 | 6/1985 |

* cited by examiner

*Primary Examiner*—Renee Luebke
(74) *Attorney, Agent, or Firm*—Kenyon & Kenyon

(57) ABSTRACT

A manually operated device for use with an electrical switching device, the manually operated device having a turning handle indicating a given switching position of the switching device and operatively connected to a driving axle of a rotary drive. A base plate mounted on the rotary drive has a circular rim. To assure unambiguous grip positions in varying installation positions of the switching device, the base plate can be mounted in different offset positions around the driving axle. Furthermore, the rim has a first edge segment that protrudes towards the inside of the rim. The turning handle is operatively connected to a drive plate that can be inserted inside the rim. On the drive plate, an annular second edge segment is configured with respect to a set-back edge area. In the OFF position, the two edge segments align with respect to one another so as to form a complete circular ring, without overlapping. In each position deviating from the OFF position, the second edge segment overlaps or grasps from behind the first edge segment.

14 Claims, 6 Drawing Sheets

MANUALLY OPERATED DEVICE HAVING A TURNING HANDLE FOR ELECTRICAL SWITCHING DEVICES

FIELD OF THE INVENTION

The present invention relates to a manually operated device having a turning handle for electrical switching devices, in particular circuit breakers.

RELATED TECHNOLOGY

Manually operated devices are known which can be connected to the driving axle of a rotary drive of a switching device, directly or as a door coupling handle to be secured on a switch cabinet door, for example, as described in German Patent Document No. C 43 22 214. A manually operated device of this type according to German Patent Document No. C 43 12 428, has a turning handle which indicates the specific position of the control device, the turning handle being in operative connection with the driving axle via a swiveling driver pin and a coupling part, the turning handle in a circular collar encompassing a rim of a base plate and being able to be latched and locked, using a locking slide bar, both in the ON as well as in the OFF position of the switching device, and, as a result of decoupling between the driver pin and the coupling part, an automatic turning off of the switching device not being prevented due to a fault condition, e.g., in consequence of an overload or shortcircuit.

To assure congruent switching positions of the turning handle in varying installation positions of the switching device (in general, the turning handle is always set at 12 o'clock), according to the publication German Patent Document No. U 94 05 568, a special coupling piece is required. In this coupling piece, by detaching a retaining metal piece from a driver pin piece, the end piece of a receptacle piece is removed from the recess of the driver pin piece and, in accordance with the requirements, is reinserted in a position that is offset with respect to the previous position by 90°, 180°, or 270° and is retained in this position by once again attaching the retaining metal piece on the driver pin piece. It is disadvantageous that this solution can be applied only in connection with a door coupling handle, but not in the case of directly attaching a manually operated device to a rotary drive or in the case of a plurality of switching devices that are latchable or driven in parallel.

SUMMARY OF THE INVENTION

An objective of the present invention is assuring congruent grip positions of a versatile manually operated device in different installation positions of the switching device.

The present invention provides a manually operated device having a turning handle for electrical switching devices. The turning handle (5) indicates the specific switching position of the switching device (1), and is in operative connection with the driving axle (22) of a rotary drive (2) of the switching device (1). A base plate (4) is mounted on the rotary drive (2) having a circular rim (41). The base plate (4) can be mounted, using fasteners, in different offset positions around to the driving axle (22). A circular first edge segment (42) is formed on the rim projecting towards the inside. The turning handle (5) is in operative connection with a drive plate (6; 6') that can be brought into engagement with the driving axle (22) and which can be inserted inside the rim (41). A circular second edge segment (62; 62') is formed on the drive plate (6; 6') with respect to the otherwise set-back edge area (63; 63'). In the OFF position of the switching device (1), the two edge segments (42, 62 or 62') come together to form a nearly complete circle without overlapping, the set-back edge area (63; 63') forming a feed-through for the first edge segment (42). In every position deviating from the OFF position, the second edge segment (62; 62') at least partially overlaps or grasps from behind the first edge segment (42).

In the varying installation positions of the switching device, generally perpendicular and offset, in each case, by 90° from the horizontally running driving axle, the base plate can always be mounted in the same position, congruent with respect to the perpendicular, on the rotary drive of the switching device. A drive plate, on the one hand, is fixedly connected to the driving axle of the rotary drive and, on the other hand, is in operative connection with the turning handle, the drive plate being elastically coupled, in particular permitting a certain amount of play. The turning handle sits either directly on the base plate and therefore on the rotary drive of the switching device or on a switch cabinet door, an extension axle, correspondingly coded through its cross-section, in this case having to be arranged between the base plate and the turning handle. The first edge segment, provided on the base plate, and the second edge segment, provided on the drive plate, combine to make nearly a complete circle only in the position of the two segments in which the drive plate can be completely set onto the base plate and which, at the same time, constitutes the OFF position of the turning handle with respect to the base plate. Only in this mutual OFF position can the drive plate be removed from the base plate. In all other mutual positions, there is no possibility of placing the drive plate onto the base plate both as a result of obstructing the second edge segment by the first edge segment, there also being no possibility of removing the drive plate from the base plate as a result of the first edge segment being gripped from behind by the second edge segment. The manually operated device according to the present invention can be also applied to a plurality of switching devices operated in parallel or to interlocking switching devices.

The base plate may be configured as essentially square or circular, and to provide it with switching position symbols—at least for OFF and ON. Given four installation positions of the base plate, offset in each case by 90°, it is advantageous that the one edge segment amount to roughly a quarter circle and the other edge segment to roughly a three-quarter circle, complementing the former.

For many application cases, it may be advantageous to furnish the manually operated device with means for being locked in the OFF position. For this purpose, the turning handle contains a locking slide bar and a locking pin, actuated by the locking slide bar, the locking pin in the latched OFF position extending through a first locking opening in the fixed first edge segment and therefore fixing this position until being unlatched. In order to effectively prevent a locking of the manually operated device in response to unauthorized conditions, in particular in response to worn contacts of the switching device, the locking pin extends, in one part of its length, through the first locking opening and through a second locking opening configured in the set-back edge area, opposite the second edge segment. The two locking openings are configured so as to be open opposite each other and they encircle the locking pin on both sides, in the latched OFF position.

In order to lock the manually operated device in the ON position, a third locking opening is provided in the first edge segment for engaging with the locking pin. This third locking opening can be formed by removing a corresponding partial piece from the first edge segment or by removing a locking plug-in insert.

One advantageous refinement of the present invention also rests in the fact that, as a result of the cooperation of the rim of the base plate with a collar of the control bar, encircling the rim, protection against spray water is afforded. Furthermore, in the rim and in the collar, appropriate cutouts can be provided which overlap each other in the OFF position of the manually operated device, so as, only in this manner, to prepare the path for an appropriate tool to reach the mounting means which secure the turning handle on the drive axle or on the extension axle, and therefore to prevent the disassembly of the manually operated device outside the OFF position of the switching device.

Another advantageous refinement lies in the fact that in the installation of the switching device having a rotary drive inside a switch cabinet or a different surrounding housing on the switch cabinet door or the like, a further base plate is mounted in the same position as the inner base plate and the turning handle is mounted thereon. Thus even from outside, clarity and legibility of the grip positions is assured, the appearance remaining the same.

BRIEF DESCRIPTION OF THE DRAWINGS

Further details and advantages of the present invention are discussed below on the basis of the drawings, in which:.

DETAILED DESCRIPTION

Figure 1B:
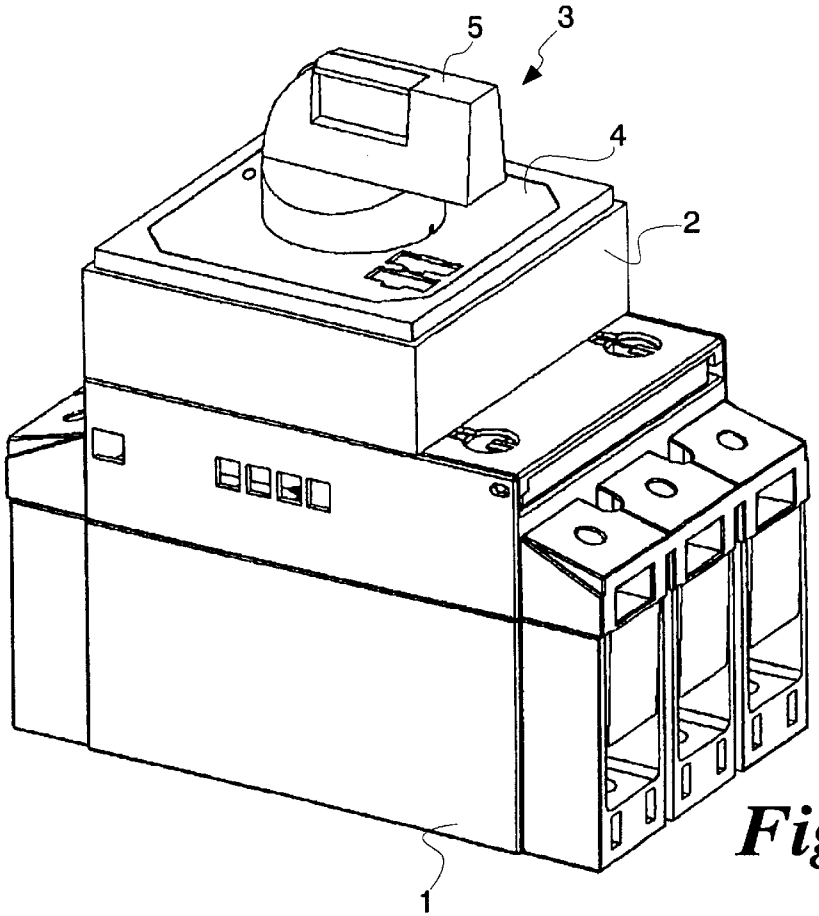
FIG. 1*b* shows a second installation position of the manually operated device in connection with the switching device.
Figure 1A:
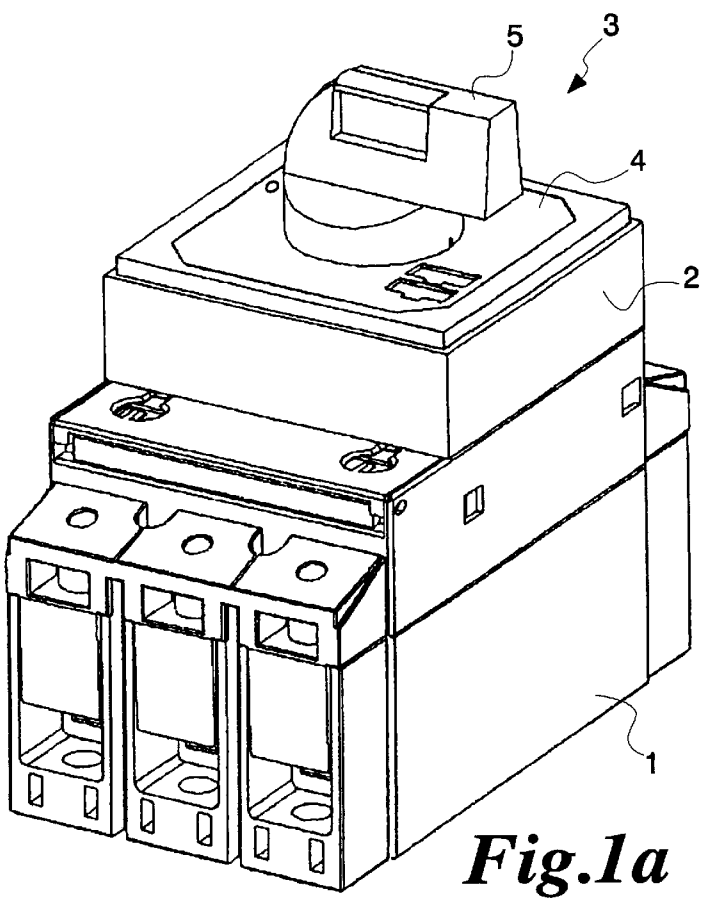
FIG. 1*a* shows a first installation position of the manually operated device in connection with a switching device.

In FIGS. 1*a* and 1*b*, a switching device 1 is depicted in the form of a circuit breaker having a front-side-mounted mechanical rotary drive 2, on which the manually operated device 3 is mounted, in two installation positions offset with respect to each other by 90°. Manually operated device 3 includes a base plate 4 secured on rotary drive 2 and a turning handle 5 set above it. In both installation positions of switching device 1, and given the same position of rotary drive 2 with respect to switching device 1, manually operated device 3 is in the same position, so that, when switching device 1 is turned off, base plate 4, its switching position symbol indicating "0" for OFF, and turning handle 5 clearly point in the direction of nine o'clock.

Figure 2A:
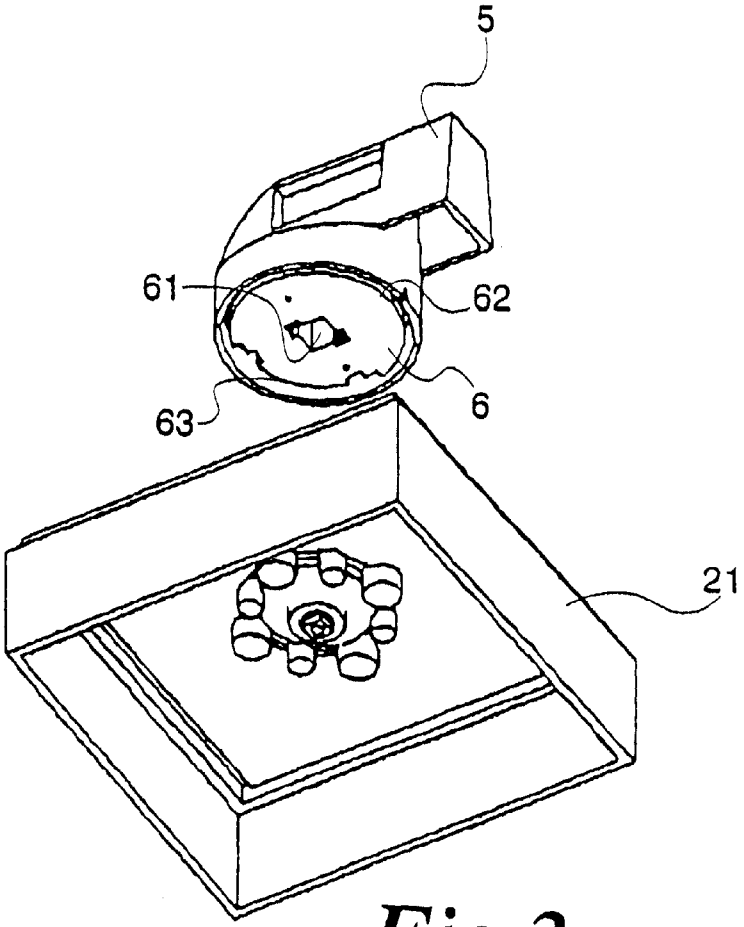
FIG. 2*a* shows a first perspective view of a partially detached representation of the manually operated device.
Figure 2B:
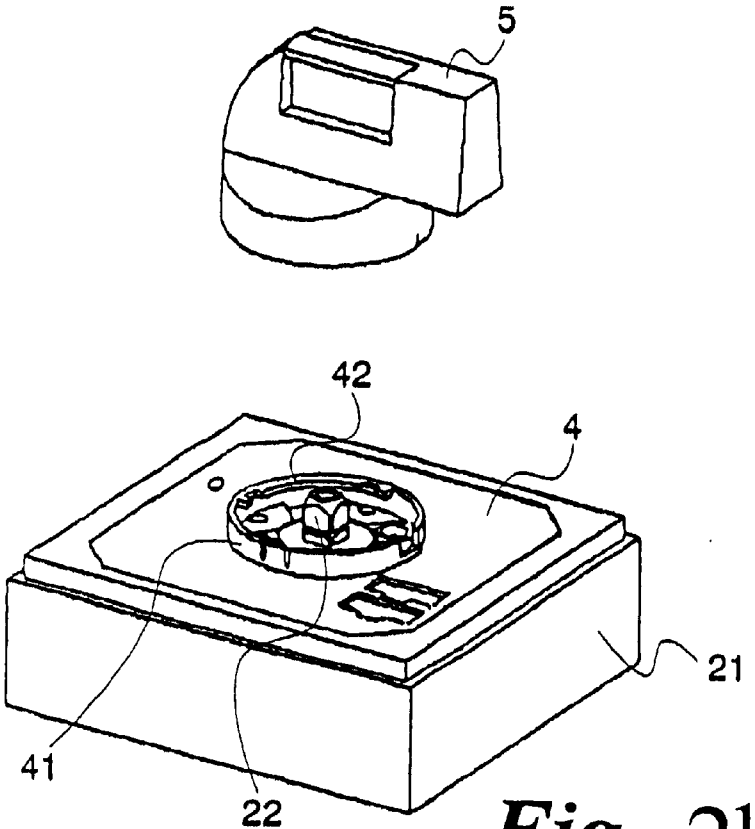
FIG. 2*b* shows a second perspective view of a partially detached representation of the manually operated device.
Figure 5:
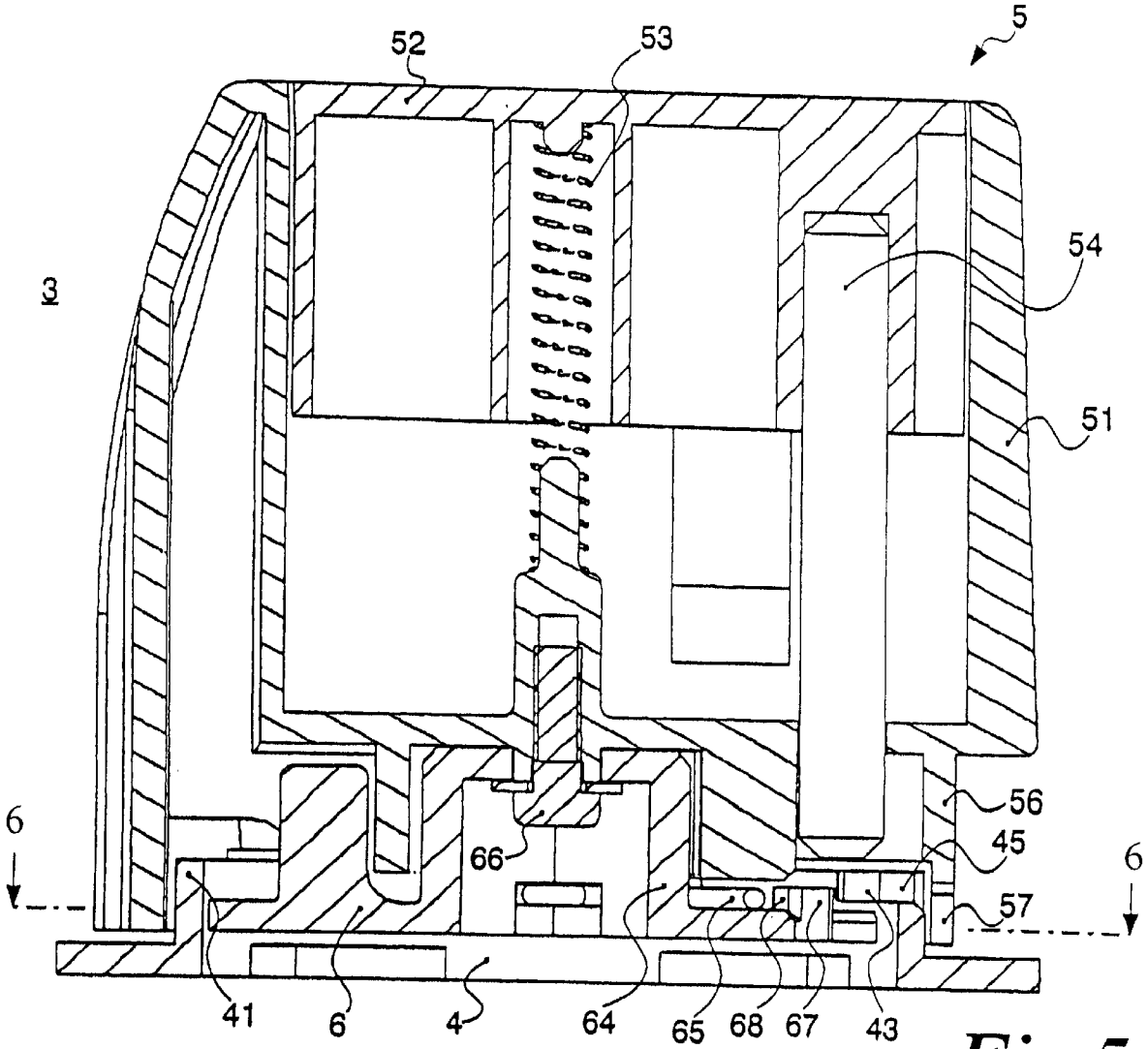
FIG. 5 shows a in a longitudinal section of the manually operated device.

In FIGS. 2*a* and 2*b*, only drive housing 21 of rotary drive 2 is shown, on which base plate 4 can be bolted in place in four positions, staggered with regard to each other, in each case, by 90° with respect to driving axle 22 of rotary drive 2. Within turning handle 5, a drive plate 6 is supported, which, on the one hand, in a receiving opening 61 grips onto driving axle 22 in a form-locking manner and, on the other hand, is in operative connection with turning handle 5 in a force-locking manner, also being subject to play. A screw connection also extends through receiving opening 61, between drive plate 6 and turning handle 5 (see also FIG. 5). Base plate 4 has a circular rim 41, on which, towards the inside, a first edge segment 42 is configured, extending virtually a quarter circle. On drive plate 6, extending virtually a three-quarters circle, a second edge segment 62 is configured facing outside with regard to edge area 63 that is otherwise set back.

Figure 3:
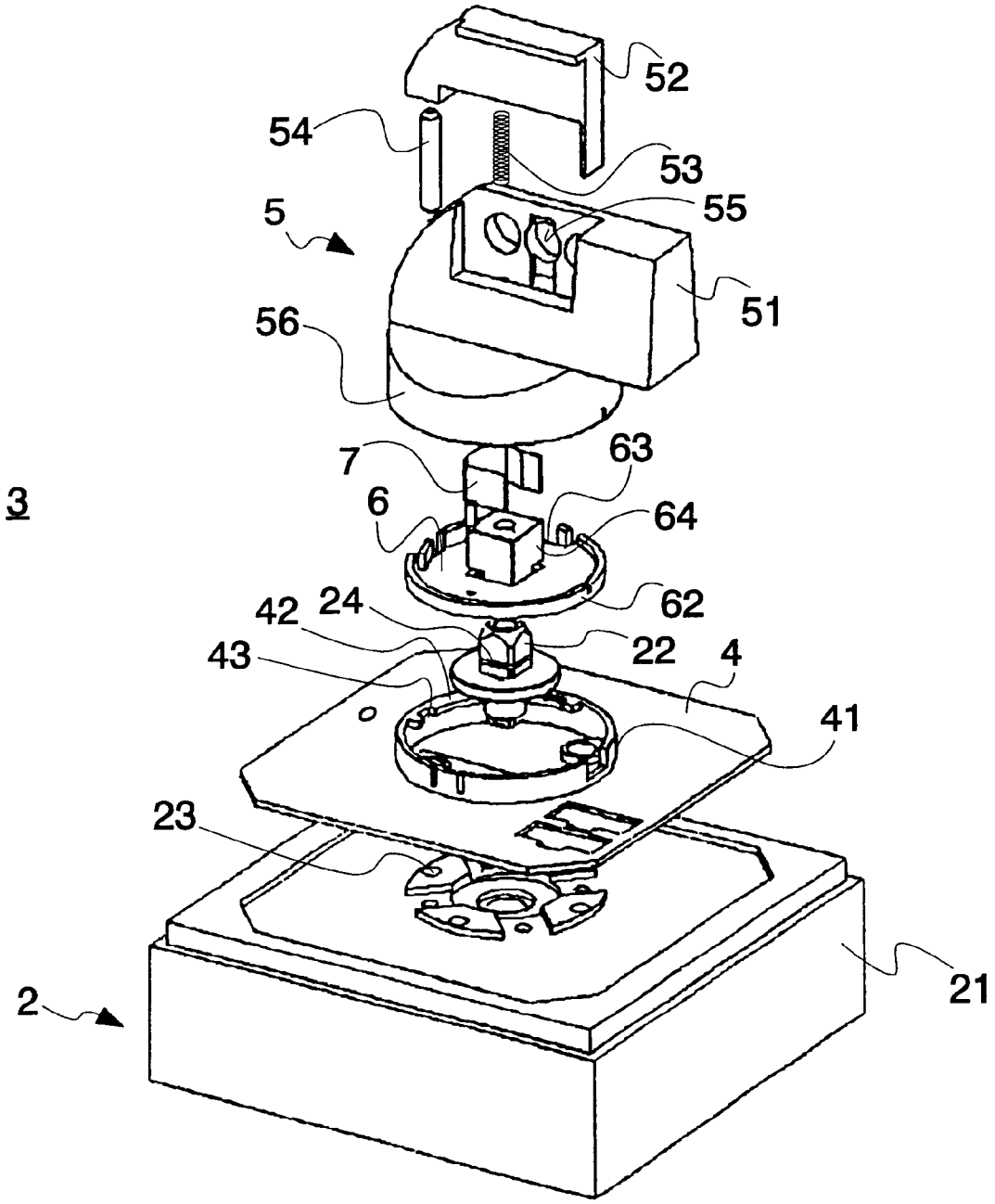
FIG. 3 shows a perspective view of the manually operated device in a detached position for direct mounting onto a switching device.
Figure 6:
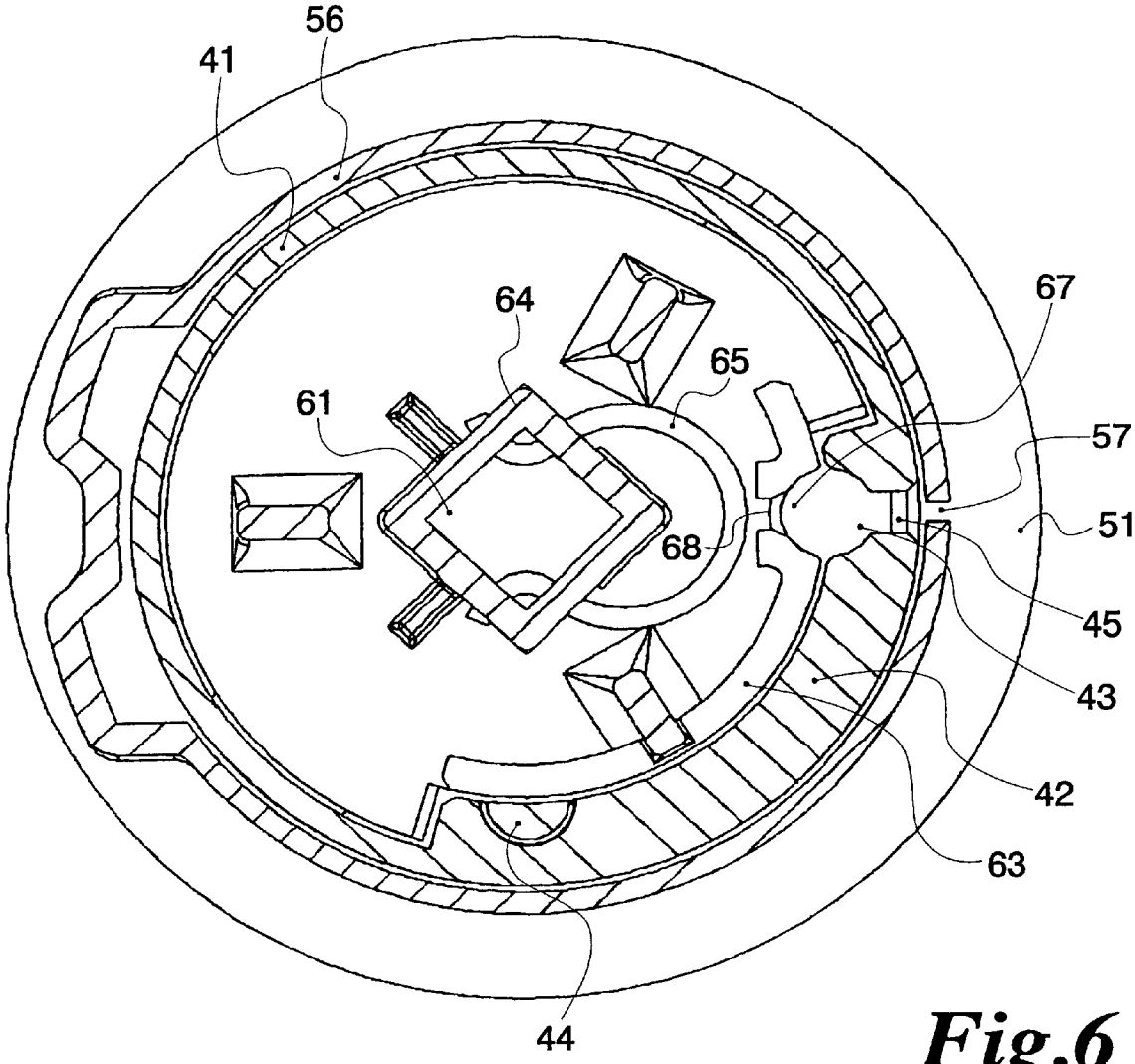
FIG. 6 shows a cross-sectional view of the manually operated device along the line 6—6 from FIG. 5.

According to FIG. 3, turning handle 5 is composed of a base 51 and a locking slide bar 52 supported therein, the locking slide bar 52, in response to actuation against a compression spring 53, acting upon locking pin 54 in the direction of rotary drive 2 and, in the OFF position, grasping the locking pin 54, so as to latch the locking pin 54, through a first locking opening 43 in first edge segment 42 of base plate 4, and into a locking bore hole 23 of drive housing 21. In this position, manually operated device 3 can be locked by hanging one or more shackle-type locks in shackle openings 55 provided for this purpose in base 51. Drive housing 21, corresponding to the four installation positions of base plate 4, has a plurality of identical locking bore holes and mounting bore holes. Drive plate 6, with the assistance of a cube-shaped driver pin 64, in whose interior receiving opening 61 is configured, is connected to turning handle 5 as an elastic connecting link via a U-shaped plate spring 7. Only in the depicted OFF position between turning handle 5 and drive plate 6, on the one hand, and base plate 4, on the other hand, can drive plate 6, together with turning handle 5, be inserted into and removed from base plate 4. In the OFF position, first edge segment 42 and second edge segment 62 combine to form a full circle, leaving small tolerance gaps, without resulting in any mutual overlapping of these edge segments 42 and 62. In being inserted and removed, first edge segment 42 of base plate 4 moves unhindered through set-back edge area 63 of drive plate 6. In positions that only slightly deviate from the OFF position, overlapping occurs between two edge segments 42 and 62, in such a way that this overlapping prevents the insertion of drive plate 6 inside the circular rim 41, or first edge area 42 partially extending over second edge area 62 prevents the removal of drive plate 6. The connection of drive plate 6 to driving axle 22 takes place via a stop spring 65 (in this regard, see also FIG. 6) secured on driver pin 64 and engaging in a circular groove 24 of driving axle 22. In the mounted state, turning handle 5 in its circular collar 56 encompasses rim 41 of base plate 4, so that in this manner protection is afforded against dirt and spray water. The ON position, having the switching positions symbol "1" assigned to it for ON, points in the direction of twelve o'clock.

Figure 4:
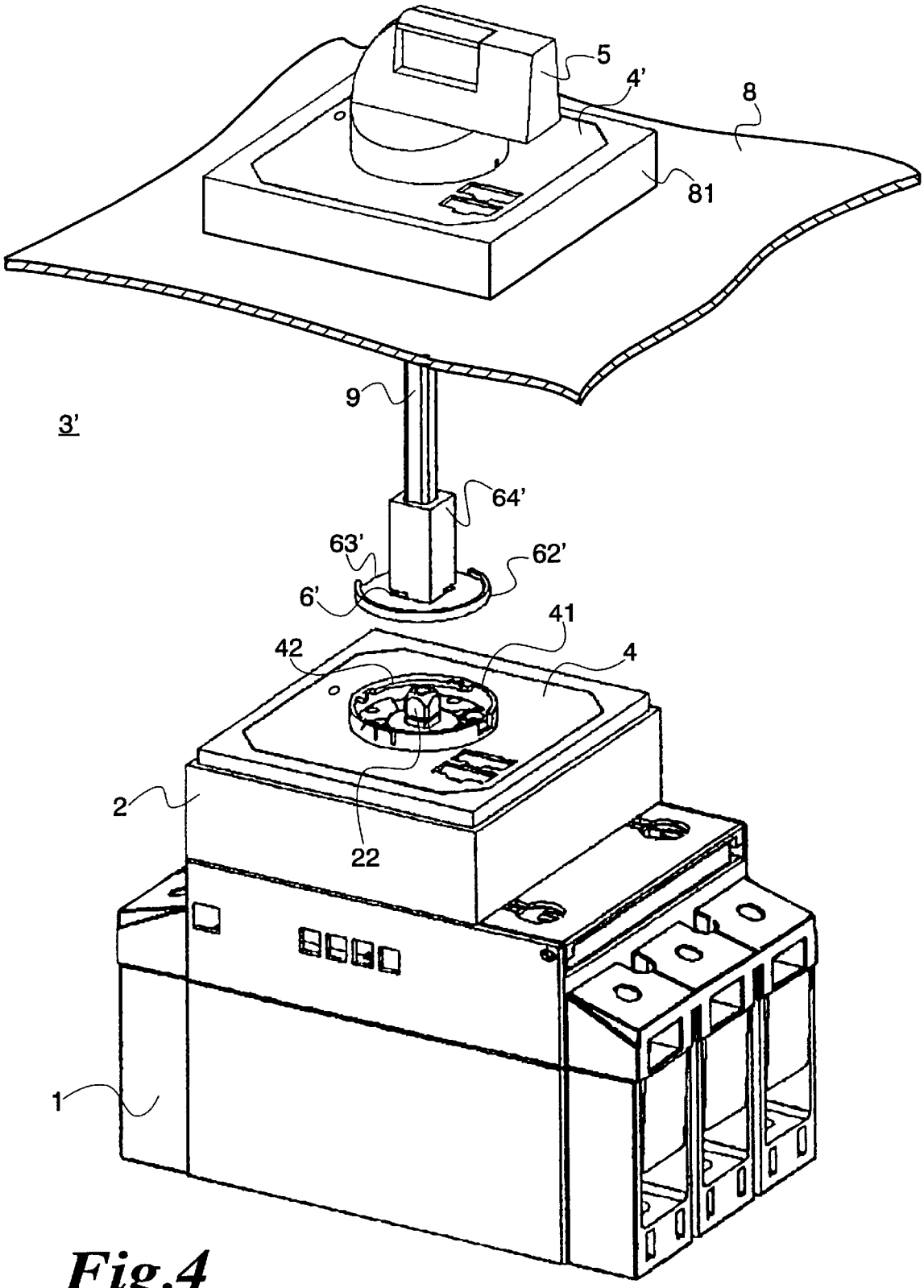
FIG. 4 shows a perspective, partially detached representation of the manually operated device with a switch cabinet door.

FIG. 4, depicts a manually operated device 3', when switching device 1 having rotary drive 2 is arranged within a switch cabinet, of which switch cabinet door 8 is sketched in fragmentary fashion. On rotary drive 2, base plate 4 is secured in the required position. In the OFF position, a drive plate 6' can be inserted into circular rim 41 of base plate 4, for which purpose drive plate 6' for its part has a protruding second edge segment 62', constituting a three-quarter circle, and an otherwise set-back edge area 63', which, in turn, in the manner depicted above, cooperates with first edge segment 42 of rim 41. Drive plate 6' has a rectangular driver pin 64', which driving axle 22 engages from behind and which an extension axle 9 engages from in front. Extension axle 9, bolted onto drive plate 6', is coded with respect to its cross-section, as a result of which the assembly of manually operated device 3' is assured such that the position of its components is unambiguous. On the outside, on switch cabinet door 8, a generally known door coupling 81 is secured, and on it is secured a further base plate 4', which is configured and aligned in the same manner as interior base plate 4 and on which turning handle 5 is mounted. Therefore, again independently of the installation positions of switching device 1, an unambiguous orientation and direct reading of manually operated device 3' is assured, the OFF position being in the direction of nine o'clock and the ON position being in the direction of 12 o'clock. Door coupling 81 mainly produces a separable connection between extension axle 9 and manually operated device 3'.

In FIGS. 5 and 6, once again manually operated device 3 is depicted in longitudinal and in cross section, respectively. In base 51 of turning handle 5, locking slide bar 52, compression spring 53, and locking pin 54 are supported. Base 51 embraces in its circular collar 56 circular rim 41 of base plate 4. Drive plate 6 is bolted to base 51 via driver pin 64 and using a bolt 66. In the depicted OFF position, located opposite first locking opening 43 and configured so as to be open in first edge segment 42 of base plate 4, is a second locking opening 67, also configured so as to be open, in set-back edge area 63 of drive plate 6. When the main contacts of the switching device are properly open in response to a latching of manually operated device 3, cylindrical locking pin 54 extends for half its length through these two locking openings 43 and 67. To lock manually operated device 3 in the ON position, in edge segment 42 a third locking opening 44 is provided, which, if necessary, is punched out and which, in the ON position, is located opposite second locking opening 67, so as to permit locking pin 54 to pass through. To separate turning handle 5, having associated drive plate 6, from rotary drive 2, stop spring 65 must be brought out of engagement with groove 24 of driving axle 22 (in this regard, see also FIG. 3). For this purpose, a first feed-through opening 57 is provided in collar 56, a second feed-through opening 45 is provided in first edge segment 42, and a third feed-through opening 68 is provided in set-back edge area 63. As a result of the OFF position, feed-through openings 57, 45, 68 and locking openings 43, 67 are brought so as to be situated one behind the other. If manually operated device 3 is in the unlatched OFF position, then access is provided for a sharp tool through openings 57, 45, 43, 67, 68 in order to actuate stop spring 56. In the latched OFF position, this access is blocked by locking pin 54, and in all other positions even slightly deviating from the OFF position access is blocked by rim 41. In addition, access to a bolt attaching means for base plate 4 is located within rim 41. Therefore, for reasons of safety, it is only possible to detach turning handle 5 and subsequently base plate 4 from rotary drive 2 in the unlatched OFF position.

The present invention is not limited to the specific embodiments described above but rather also includes all specific embodiments equivalently in the meaning of the present invention. Thus, for example, the present invention can be refined such that punched out third locking opening 44 can be shut by a corresponding plug-in insert or that third locking opening 44 in first edge segment 42 can be produced or shut again by removing or replacing a plug-in insert, respectively. Furthermore, the present invention can be transformed by using circular base plates or square ones furnished with rounded-off comers. In addition, the present invention is not limited to edge segments 42 and 62 that extend a quarter and a three-quarters circle respectively, for example, as long as they combine to form a full circle.

What is claimed is:

1. A manually operated device for use with an electrical switching device, the manually operated device comprising:

a turning handle capable of indicating a switching position of the switching device;

a rotary drive including a driving axle;

a base plate disposed on the rotary drive, the base plate having a circular rim, the rim including a partially circular first edge segment projecting in an inward direction; and a drive plate in operative connection with the turning handle, the drive plate including a partially circular second edge segment, the drive plate being engageable with the driving axle and insertable inside the rim;

wherein the first edge segment is aligned with the second edge segment so as to form a nearly complete circle when the turning handle is positioned so as to indicate an OFF position of the switching device, and the second edge segment at least partially overlaps the first edge segment when the turning handle is positioned so as to indicate a position other than the OFF position of the switching device.

2. The manually operated device as recited in claim 1 wherein the base plate is mountable in different offset positions around the driving axle.

3. The manually operated device as recited in claim 1 wherein the base plate includes an approximately rectangular shape and at least one switching position symbol.

4. The manually operated device as recited in claim 1 wherein the base plate includes a circular shape and at least one switching position symbol.

5. The manually operated device as recited in claim 1 wherein one of first and second edge segments constitutes approximately one quarter and the other of the first and second edge segments constitutes approximately three-quarters of a complete annular ring.

6. The manually operated device as recited in claim 1 further comprising:

a switch cabinet;

a second base plate, the turning handle mounted on the switch cabinet via the second base plate; and an extension axle disposed between the turning handle and the drive plate.

7. The manually operated device as recited in claim 1 wherein the drive plate further includes a set-back edge area forming a feed-through for the first edge segment when the turning handle is positioned so as to indicate an OFF position of the switching device.

8. The manually operated device as recited in claim 7 wherein the turning handle further includes a circular collar at least partially covering the drive plate and the circular rim.

9. The manually operated device as recited in claim 8 wherein the collar includes a second feed-through opening, the first and second feed-through openings permitting access only when the turning handle is positioned so as to indicate an OFF position of the switching device so as to enable the turning handle to be separated from the driving axle.

10. The manually operated device as recited in claim 1 wherein the turning handle further includes a locking slide bar and a locking pin, wherein the locking pin is actuated by the slide bar so as to extend through a first locking opening in the first edge segment when the turning handle is positioned so as to indicate the OFF position of the switching device.

11. The manually operated device as recited in claim 10 wherein the locking pin extends into an opening formed by the first edge segment and the second edge segment when the turning handle is positioned in the OFF position.

12. The manually operated device as recited in claim 11 wherein the locking pin extends into a third locking opening located in the first edge segment when the turning handle is positioned so as to indicate an ON position of the switching device.

13. The manually operated device as recited in claim 12 wherein the third locking opening is capable of being punched out.

14. The manually operated device as recited in claim 13 wherein the third locking opening can be closed using a plug-in insert.

* * * * *

UNITED STATES PATENT AND TRADEMARK OFFICE

CERTIFICATE OF CORRECTION

PATENT NO. : 6,423,912 B1
DATED : July 23, 2002
INVENTOR(S) : Rainer Arenz and Tom Kitzing It is certified that error appears in the above-identified patent and that said Letters Patent is hereby corrected as shown below:

Column 6,
Line 2, “comers” should be -- corners --.

Signed and Sealed this

Tenth Day of June, 2003

JAMES E. ROGAN
*Director of the United States Patent and Trademark Office*